US008302539B2

(12) United States Patent
Chang

(10) Patent No.: US 8,302,539 B2
(45) Date of Patent: Nov. 6, 2012

(54) FOLDING TABLE WITH POSITIONING FUNCTION

(76) Inventor: Chien-Kuo Chang, Taichung (TW)

( * ) Notice: Subject to any disclaimer, the term of this patent is extended or adjusted under 35 U.S.C. 154(b) by 258 days.

(21) Appl. No.: 12/884,226

(22) Filed: Sep. 17, 2010

(65) Prior Publication Data

US 2012/0067256 A1 Mar. 22, 2012

(51) Int. Cl.
*A47B 3/08* (2006.01)

(52) U.S. Cl. ..... 108/115; 108/130

(58) Field of Classification Search ..... 312/223.3, 312/194, 195, 258; 248/166, 439; 108/115, 108/125, 126, 129, 130, 50.01, 50.02
See application file for complete search history.

(56) References Cited

U.S. PATENT DOCUMENTS 2,870,459 A * 1/1959 Zabielski ..... 5/2.1
3,527,174 A * 9/1970 Lay ..... 108/115
3,628,471 A * 12/1971 Burr ..... 108/132
4,055,124 A * 10/1977 Weagle ..... 108/132
5,365,861 A * 11/1994 Gutgsell ..... 108/132
6,752,090 B2 * 6/2004 Schenker et al. ..... 108/115
2008/0149006 A1 * 6/2008 Leng ..... 108/121
2008/0272266 A1 * 11/2008 Eustace et al. ..... 248/423
2009/0078173 A1 * 3/2009 Topham et al. ..... 108/77
2011/0155021 A1 * 6/2011 Geitner ..... 108/25
2011/0194890 A1 * 8/2011 Chang ..... 403/241

* cited by examiner

*Primary Examiner* — Janet M Wilkens

(57) ABSTRACT

A folding table with positioning function is provided. Therein a table board, two support sets pivotally connected and parallel with the table board and a fixing frame pivotally connected with the table board between and perpendicular to the two support sets are included. The two support sets each contain at least one holder having at least one positioning hole at one side thereof and the two support sets can engage with the fixing frame by connecting ends of the fixing frame, wherein the connecting end is inserted with a spring member having a pin movably projecting from a through hole corresponding to the positioning hole and engaging with the positioning hole when the two support sets and the fixing frame are unfolded so as to secure the folding table stably.

5 Claims, 9 Drawing Sheets

FOLDING TABLE WITH POSITIONING FUNCTION

BACKGROUND OF THE INVENTION

1. Technical Field

The present invention relates to an improvement of foldable tables, and more particularly, to a folding table with a positioning function that is simple and economical in structure, easy to fold and unfold, and highly stable during use.

2. Description of Related Art

Conventionally, unfoldable tables such as desks, dining tables, computer tables and the like are fixedly constructed by screwing arrangement. Thus, it is inconvenient for people to transport and store such unfoldable tables as they are considerably bulky. In addition to that, such tables lack of application flexibility as being fixedly constructed. Users have to assemble by screwing such tables firmly before use, undo it before storage, and redo it prior to its reuse. Therefore, unfoldable tables increase cost in transportation and inconvenience in application.

As an improvement on the inconvenient unfoldable tables, folding tables are now widely available on the market. A folding table typically has a pivotal arrangement connecting between its table board and table supporter beneath the table board, e.g. table legs, so as to pivotally connect the legs with the table board and to allow the legs to be folded to become parallel with the table board or extended to become perpendicular to the table board. As above described, folding tables realize the needs for easy transport and storage. However, there is no proper supporting and fixing arrangement for securing table legs so the overall firmness of the unfolded table is reduced. When an unbalanced weight is placed upon the table board or when the table legs get impacted, it is likely that the legs lean or collapse to make the table lose balance and tumble.

Furthermore, while only fixing parts of a reduced number are used in a folding table as compared with a conventional DIY detachable table, for minimizing a folding table and facilitating transportation, there are still some parts left for an end user to assemble with tools and thereby construct the table for use. This is also an inconvenience to be overcome.

In sum, a conventional folding table has no reliable supporting and fixing structure for securing its table legs against leaning or tumbling when the table bears an unbalanced weight or get accidently hit at any of the legs. Besides, there is a disadvantage with regard to its assemblage, as some parts need to be put together by end users.

SUMMARY OF THE INVENTION

To overcome the shortcomings of the traditional folding tables, the present invention provides a folding table with a positioning function. The folding table primarily comprises a table board, two support sets and a fixing frame.

Referring to figures of the present invention, the two support sets are pivotally connected with the table board and allowed to be folded to become parallel with the table board and unfolded to become perpendicular to and support the table board, and the fixing frame is pivotally connected with the table board and between the two support sets, so that the fixing frame is allowed to be folded to become parallel with the table board and unfolded to become perpendicular to and support the table board in cooperation with the two support sets. The folding table is characterized in that each said support set has at least one holder that has at least one positioning hole provided on one side thereof, and the fixing frame, at a free side thereof, has bilateral connecting ends. The connecting end has at least one through hole corresponding to the positioning hole and at least one spring member inserted in the connecting end, and the spring member projects from the through hole with a pin corresponding to the positioning hole so as to make the pin removably engage the positioning hole, thereby when the pins engaging the positioning holes, the two support sets and the fixing frame being fixed and positioned with respect to each other to secure the folding table in use.

The implementation of the present invention can achieve at least following objectives.

The most important objective of the present invention is to provide the foregoing folding table by virtue of coordination between the spring member and the holder for fixing and positioning the fixing frame and the support sets properly so as to secure the support sets and prevent from accidentally folding.

Another objective of the present invention is to provide the foregoing better solution to users by means of adopting the structure between the fixing frame, the spring member, the holder and the two support sets that using no screws for combination thereof to achieve an easy and quick assembling or disassembling operation without utilizing any tools. It improves the convenience in assembling and storing aspects as well as reducing the number of parts used, thus avoiding missing parts.

Another objective of the present invention is to offer the foregoing folding table featuring the fixing frame and the two support sets which are foldable so as to reduce the folding table in volume for easy carry or storage and therefore save transport cost and space.

Another objective of the present invention is to provide the foregoing folding table featuring the holder having a guiding edge jutting upward from the opposing side where the positioning hole locates. The guiding edge guides the movable pin to be withdrawn into the through hole thereby enhancing convenience in quick extension and assembling.

Another objective of the present invention is to provide the foregoing folding table in simple structure that is easy to produce and use no screwing parts, thereby reducing the manufacturing cost.

Another objective of the present invention is to supply the foregoing folding table having a plate provided to the fixing frame, thereby reinforcing supporting effect and adding aesthetic sensation to the folding table.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of an illustrative embodiment when read in conjunction with the accompanying drawings, wherein:

DETAILED DESCRIPTION OF THE PREFERRED EMBODIMENT

For the convenience of explanation of the concept of subject matter in the present invention, herein discloses a preferred embodiment. It is noted that all objects contained in the embodiment are described in an appropriate ratio, scale, deformation or displacement quantities applicable to the scope of explanation purpose rather than the ratio of any actual elements of the present invention.

Figure 1:
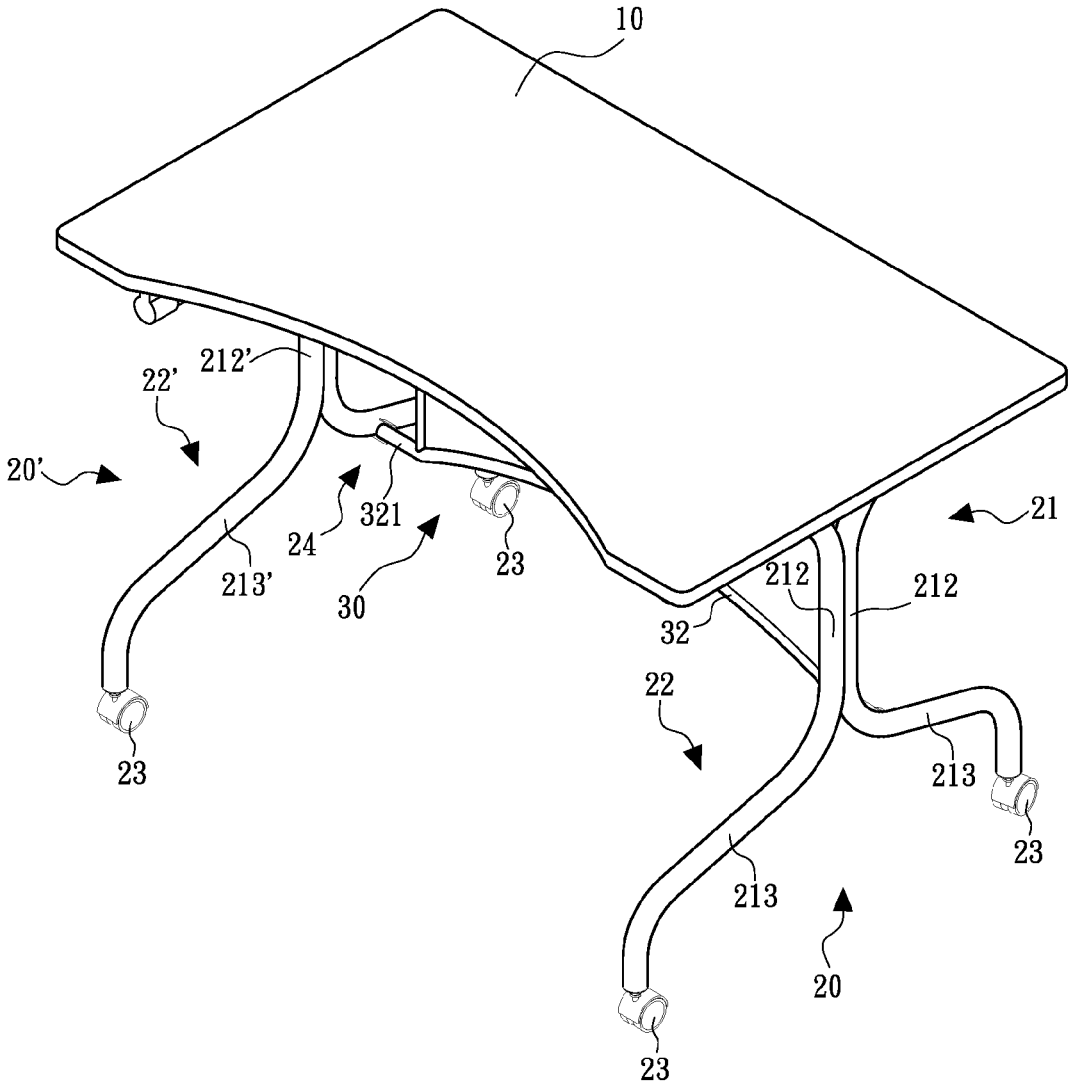
FIG. 1 is a perspective view of a folding table with a positioning function according to the present invention.
Figure 2:
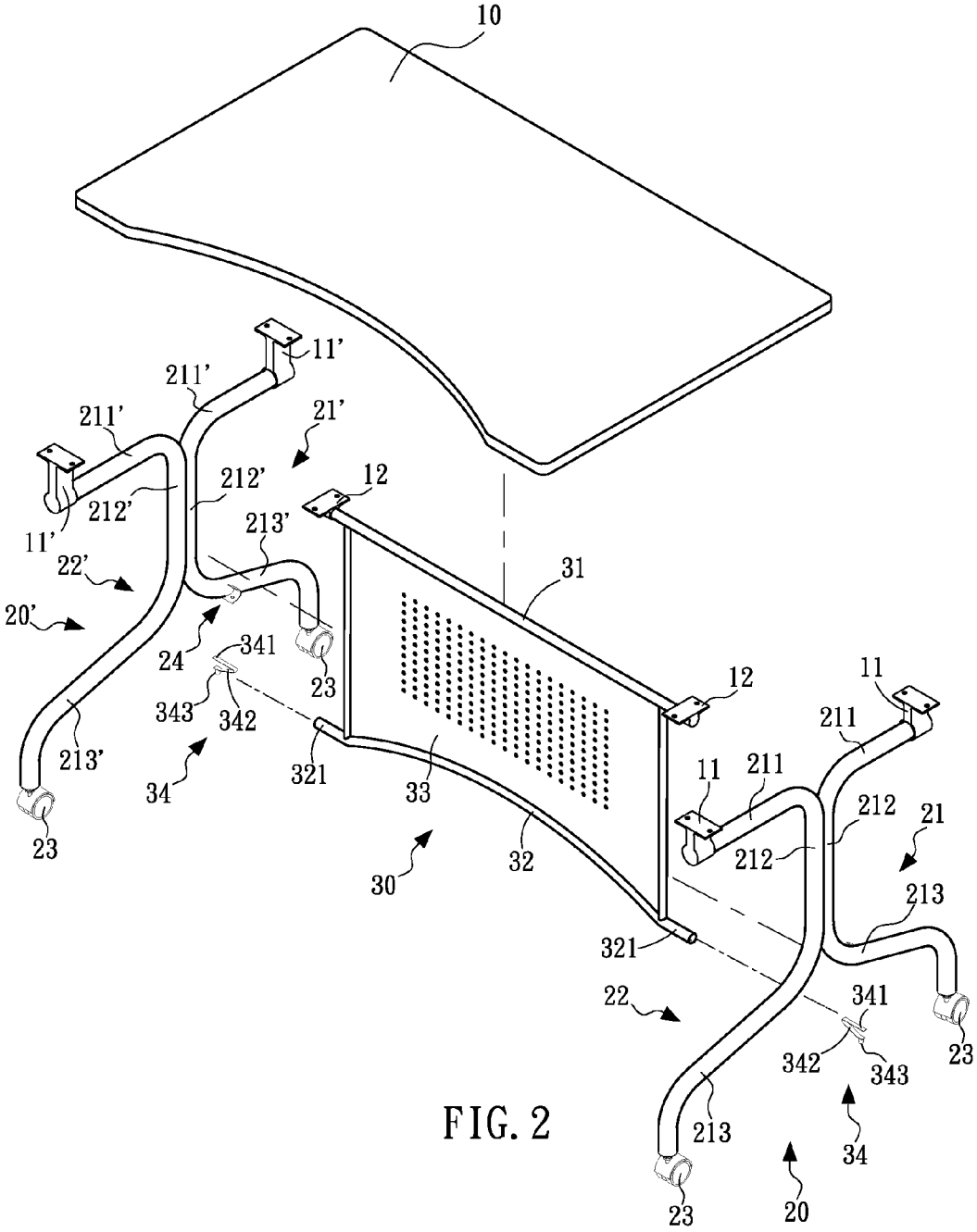
FIG. 2 is an exploded view of the folding table in the present invention.

By referring to FIG. 1 and FIG. 2, figures include a perspective view and an exploded view of the folding table with positioning function in the present invention composed of a table board 10, two support sets 20, 20' and a fixing frame 30. The layout and function of said elements in the folding table are described as set forth in the following paragraphs.

The table board 10 is an approximately rectangular plate having a bottom surface and near each end of laterals thereof is equipped with at least one first pivotal joint 11 or 11' while at least one second pivotal joint 12 is provided between each pair of the first pivotal joints 11 or 11'. The adjacent first pivotal joints 11 at the same side of the table board 10 are smaller than the first pivotal joints 11' at the opposite side of the table board 10 in vertical length (height).

The two support sets 20, 20' are connected respectively with the first pivotal joints 11, 11'. For cooperating with the first pivotal joints 11, 11' of different vertical lengths to support the table board 10 level in use, the support sets 20 connected to the first pivotal joints 11 is greater than the support sets 20' in vertical length (height) so that the support set 20 can be folded with respect to the table board 10 and then overlaid by the other support set 20' when the folding table is folded. The two support sets 20, 20' each include a first support half 21 or 21' and a second support half 22 or 22' set abreast the first support half 21 or 21'. Each of the first and the second support half contains at least one pivoting segment 211 or 211', at least one combining segment 212 or 212' extended inward and downward from the pivoting segment 211 or 211', and at least one supporting segment 213 or 213' extended downward and outward from the combining segment 212 or 211'. Therein, the pivoting segments 211, 211' are pivotally connected to the table board 10 from bottom by the first pivotal joints 11, 11' while each said first support half 21 or 21' is combined with the adjacent second support half 22 or 22' at the combining segments 212, 212' through soldering or screwing. Each end of the supporting segments 213, 213' of the first and the second support halves is connected with a caster 23 for sliding the folding table.

Figure 6:
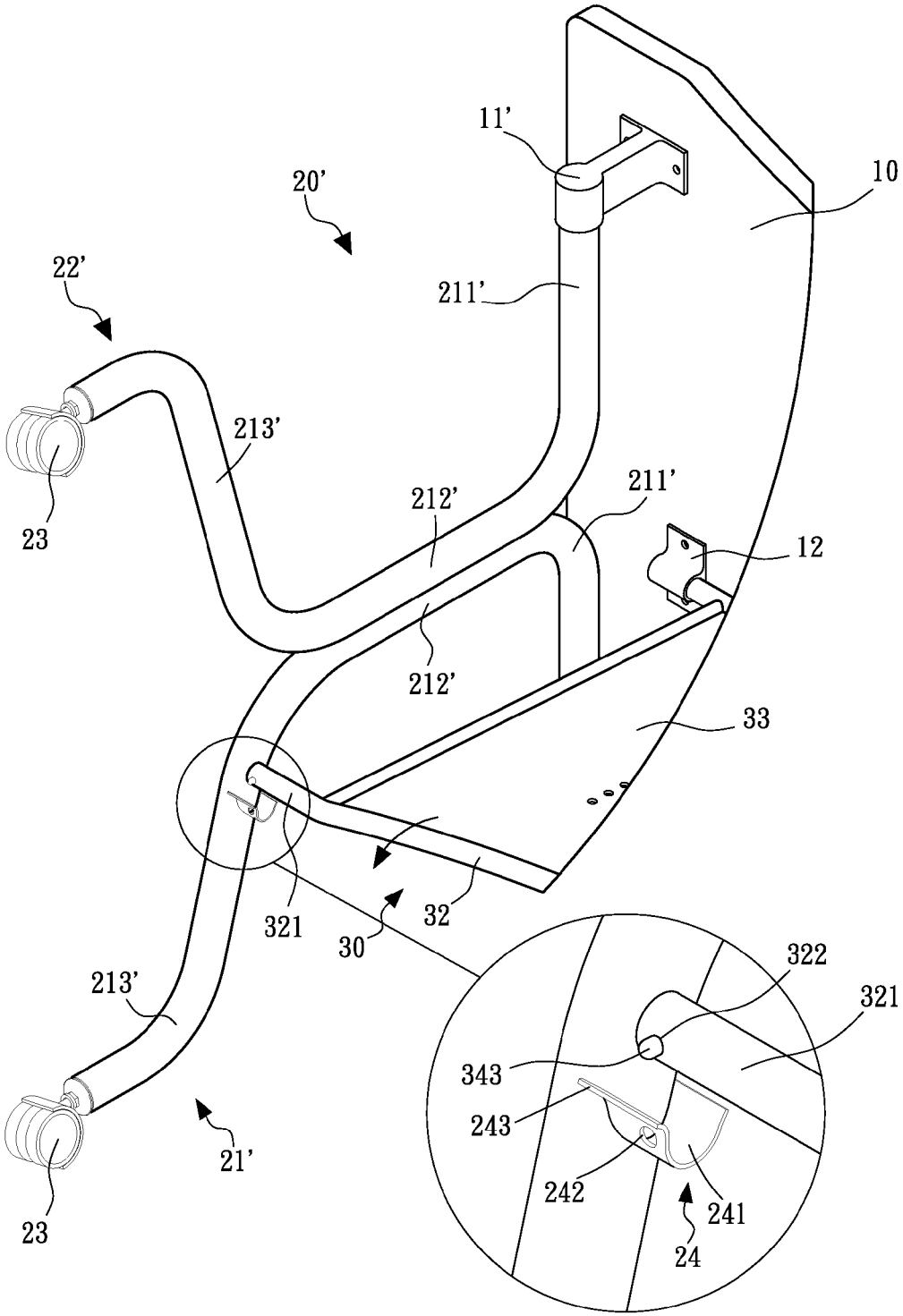
FIG. 6 is a partial enlarged view of operational mode illustrating the folding table in the present invention when a connecting end thereof is about to be received upon the holder.

Referring to FIGS. 1, 2 and FIG. 6, holders 24 are deposited at the support halves 21, 21' and extended inward therefrom. Each said holder 24 is in an approximately U-shape having a curved retaining surface 241 formed inside and a positioning hole 242 set at one side thereof. The holder 24 has a guiding edge 243 extending slantingly upward from the side of the positioning hole 242 as shown in FIG. 6. Therein, the holders 24 may be attached to the support halves 21, 21' by any means, such as soldering.

Despite the embodiment depicted in the figures referring to the two support sets 20, 20' that are tubular poles consisting of the first support halves 21, 20' and the second support halves 22, 22', the present invention can be achieved by utilizing any supporting structure conventional applied to folding tables without limitation, such as straight tubular poles, single-layer or multi-layer wood or metal plates, or rectangular blocks. Furthermore, the first support halves 21, 21' and the second support halves 22, 22' of said support sets 20, 20' can be replaceable with any equivalents fulfilling the same supporting and folding effects regardless of their shapes and structural designs. For instance, each pivoting segment 211 or 211' combining segment 212 or 212' and supporting segment 213 or 213' of the first support half 21 or 21' or the second support half 22 or 22' can be singular which means the first support half 21 or 21' and the second support half 22 or 22' being regarded as a whole, and the caster 23 can be supplied at two ends of the supporting segment 213 or 213'.

Figure 3:
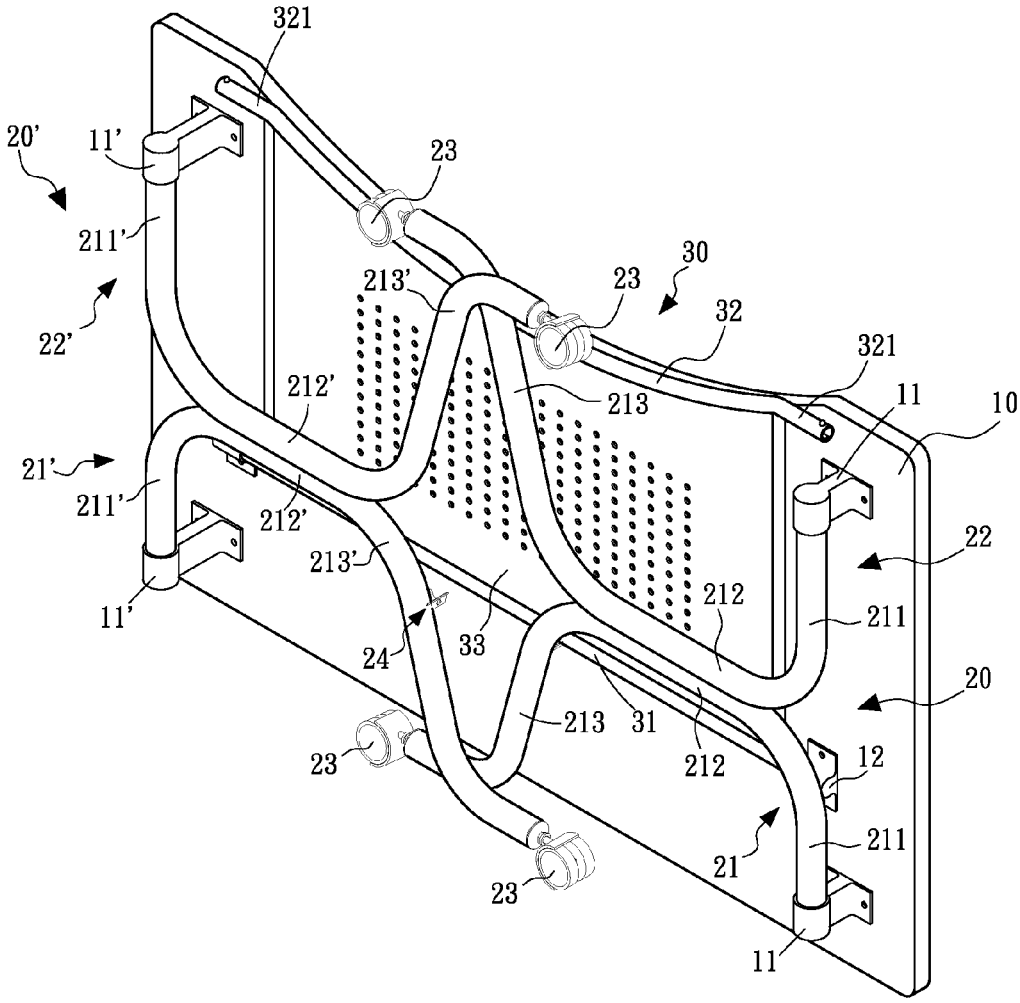
FIG. 3 is a view illustrating the folding table having two support sets and fixing frame thereof folded in parallel with the table board.

Referring to the FIG. 1 through FIG. 3, the fixing frame 30 is in an approximately rectangular shape arranged perpendicularly between the two support sets 20, 20'. The fixing frame 30 consists of a supporting rib 31, a connecting rib 32 and a plate 33; wherein the connecting rib 32 is hollow and the plate 33 is provided between the supporting rib 31 and the connecting rib 32. The supporting rib 31 has two ends jutting out from the plate 33 to connect the second pivotal joints 12 while the connecting rib 32 also has two ends jutting out from the plate 33. In other words, the fixing frame 30 is pivotable on the pivotal joints 12 with respect to the table board 10 to and fro by the supporting rib 31 and the connecting rib 32 is located at a free side of the fixing frame 30. Therefore, when the fixing frame 30 and the two support sets 20 are fully extended, they jointly form a U-shaped supporting structure beneath the table board 10.

Figure 8:
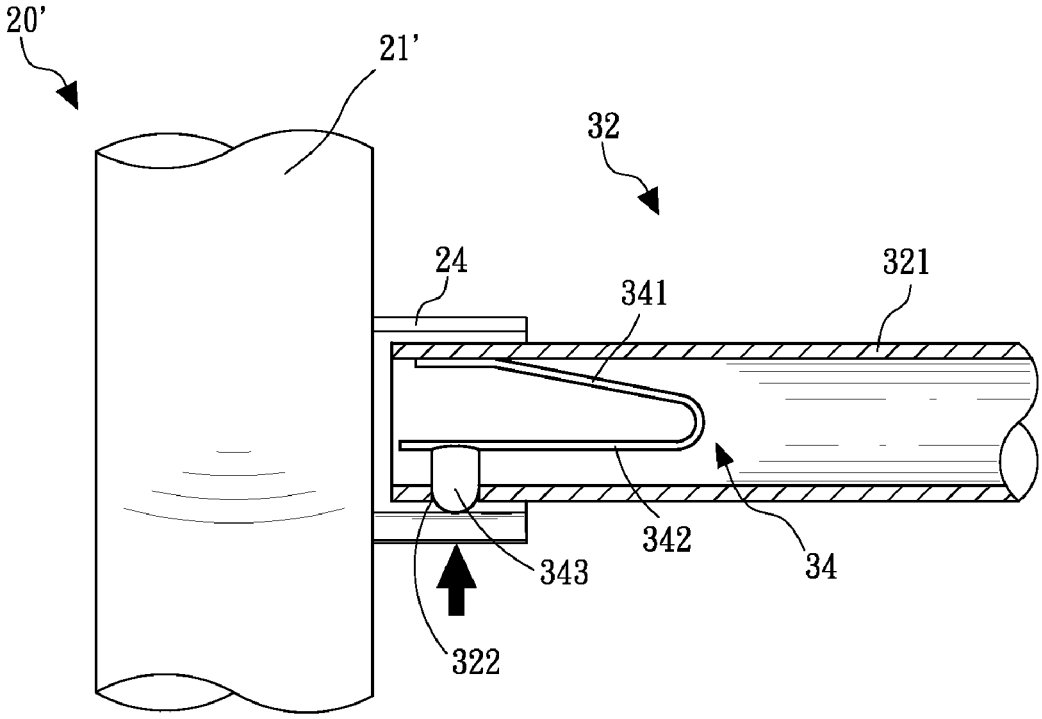
FIG. 8 is a view of operational mode illustrating the folding table in the present invention when a pin of a spring member thereof is retracted before engaging with the holder.
Figure 9:
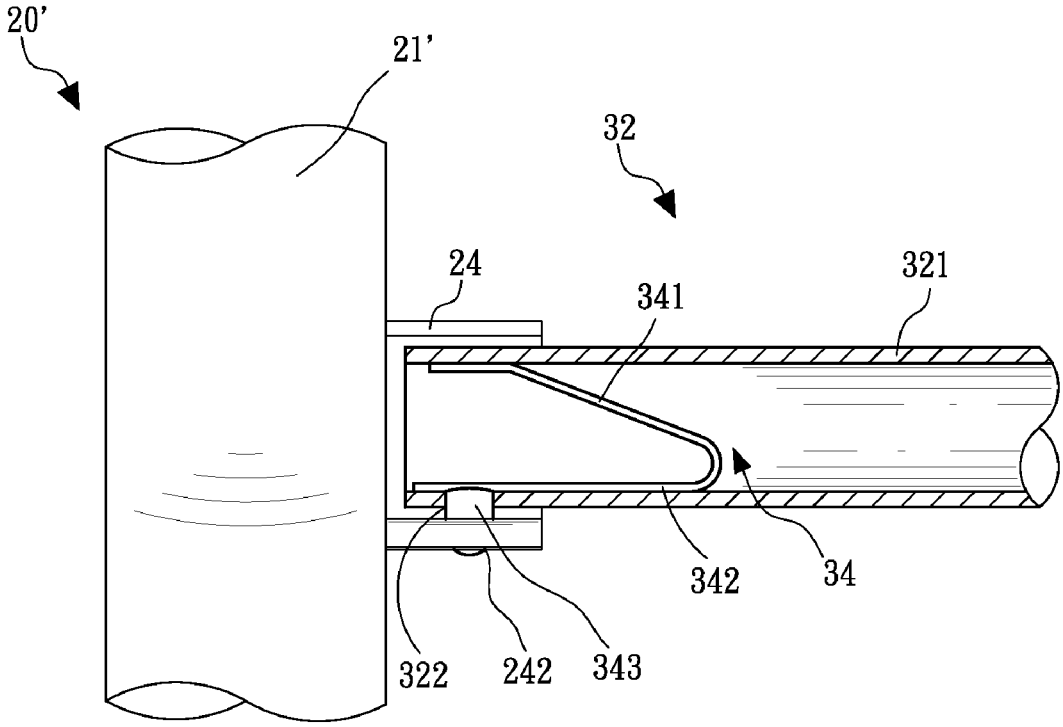
FIG. 9 is a sectional view of operational mode illustrating the folding table in the present invention when the pin of the spring member engages with the holder.

As shown in the FIG. 1 through FIG. 3 and FIG. 6, the connecting rib 32 has the two ends jutting out from the plate 33 acting as connecting ends 321. Each of the connecting ends 321 is to be rested on the retaining surface 241 of the corresponding holder 24 and thereby retained by the holder 24. The connecting end 321 has at least one through hole 322 corresponding to the positioning hole 242. As shown in FIG. 8 and FIG. 9, a spring member 34 is placed in the connecting end 321 and has a compressed portion 341 and a propping portion 342 that give the spring member 34 a U-like shape. The propping portion 342 is affixed by a pin 343 that corresponds to the through hole 322 so that the pin 343 is allowed to movably retreat or project from the through hole 322. In fact, the spring member 34 may be in any form or shape as long as it enables the pin 343 to movably retreat or project from the through hole 322.

Above description is about the structural features of the present invention, and the following context illustrates movement and principle applied to such structural features. As shown in FIG. 3, when the folding table of the present invention is folded, the fixing frame 30 is folded with respect to and parallel with the table board 10. Then the two support sets 20, 20' can be successively collapsed over the table board 10. Since the adjacent first pivotal joints 11 at the same side of the table board 10 are smaller than the first pivotal joints 11' at the opposite side of the table board 10 in vertical length (height), the lain-down support set 20 is accommodated by the first pivotal joints 11' and thus the two support sets 20, 20' are parallel with each other and with the table board 10. Thereby, the folded folding table is compact for easy transport and storage, thus saving cost and space.

Figure 4:
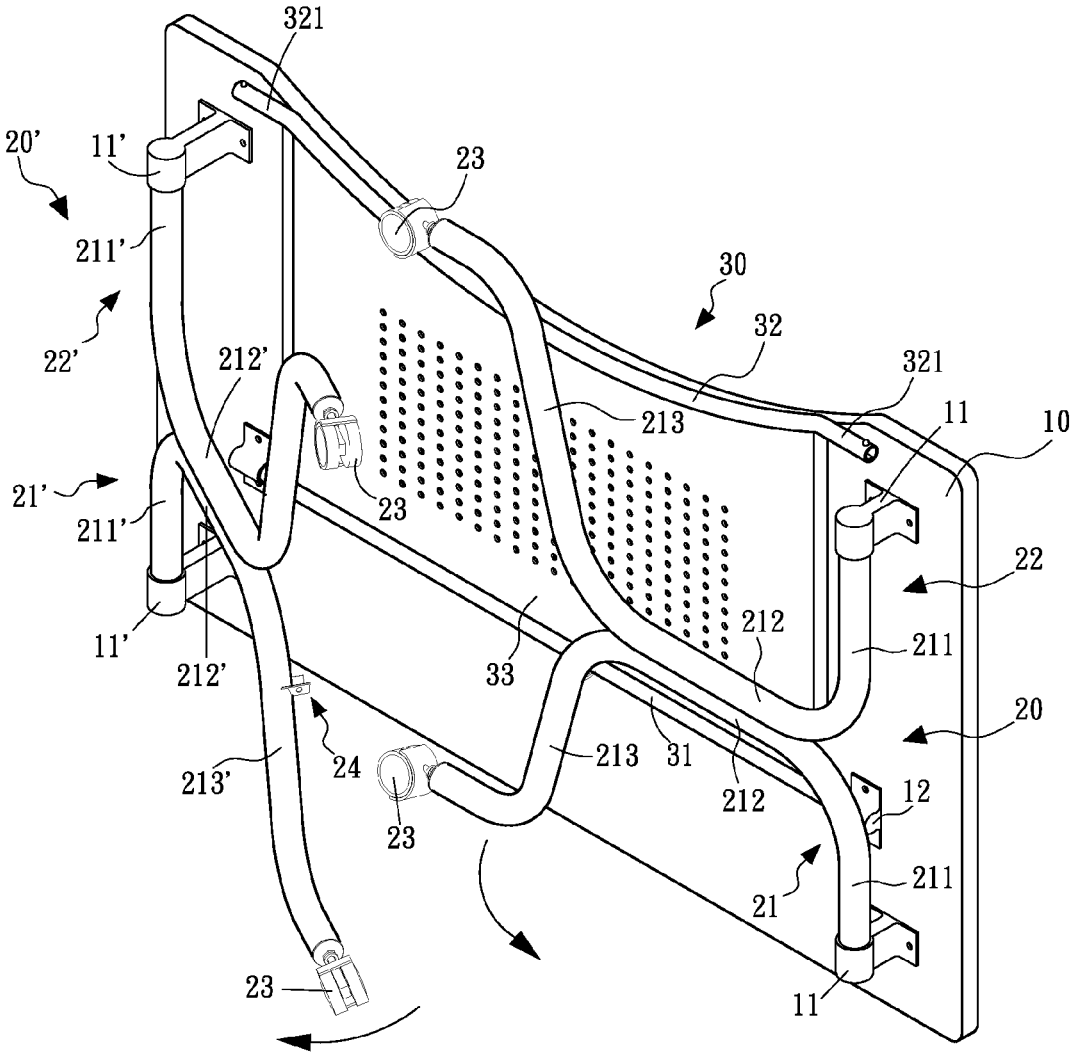
FIG. 4 is a view of operational mode illustrating the folding table in the present invention when one of the two support sets is unfolded.
Figure 5:
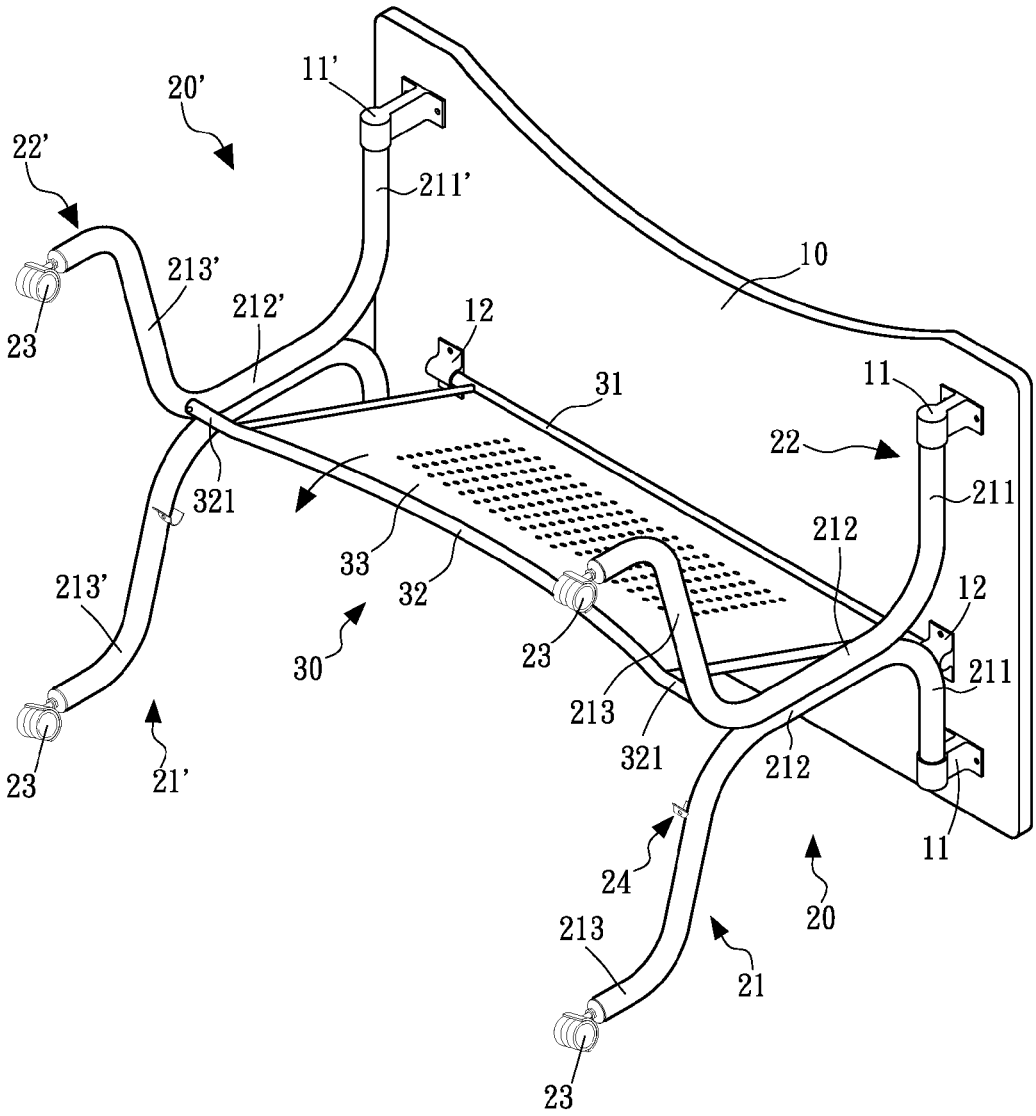
FIG. 5 is a view of operational mode illustrating the folding table in the present invention when the fixing frame is unfolded.

As illustrated in FIG. 4 through FIG. 6, before using the folding table of the present invention, an user has to bilaterally expand the two support sets 20' and 20 successively with respect to the table board 10 and expand the fixing frame 30 outward and downward with respect to the table board 10 so as to make the fixing frame 30 become perpendicular to the table board 10.

Figure 7:
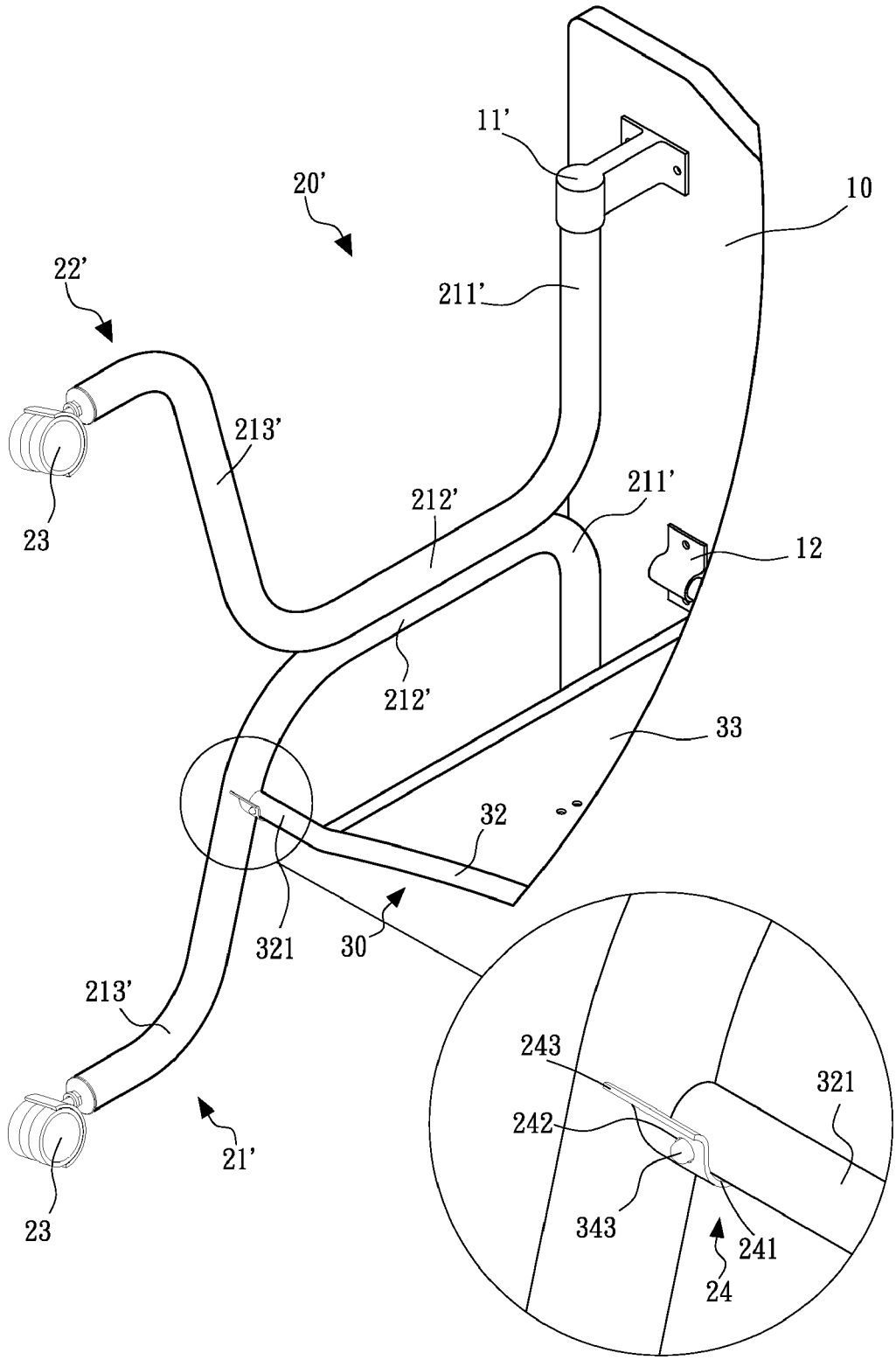
FIG. 7 is a partial enlarged view of operational mode illustrating the folding table in the present invention when the fixing frame is fully extended.

As illustrated in FIG. 6 and FIG. 7, when the fixing frame 30 is fully expanded, the connecting ends 321 of the connecting rib 32 come to the holders 24 with the pins 343 abutting against the guiding edges 243. With the connecting end 321 sliding inward the holder 24, the compressed portion 341 of the spring member 34 deforms and the pin 343 is returned back to the through hole 322 as depicted in FIG. 8.

As illustrated in FIG. 7 and FIG. 9, when each of the connecting ends 321 slides to the end in the holder 24 with the pin 343 corresponding to the positioning hole 242, the pin 343 is propped by the propping portion 342 to pierce through the through hole 322 and enter the positioning hole 242, thereby securing connection between the connecting rib 32 and the holder 24. As a result, the fixing frame 30 can be engaged by and positioned between the two support sets 20, 20' for forming the U-like supporting structure. Therefore, the folding table is expanded and stands stably without being inclined or collapsed due to an external force. Besides, the plate 33 of the fixing frame 30 also provides an additional value to the appearance of the folding table.

When the user intends to collapse the folding table, he or she can do so by pressing on the pins 343 to disengage them from the positioning holes 242 and make them return to the through holes 322, so that the connecting rib 32 can be disconnected from the holders 24. Then the user can draw the fixing frame 30 toward the table board 10 and collapse the two support sets 20, 20'. Therefore, the folding table is collapsed as shown in FIG. 3.

Featuring the fixing frame 30, the spring members 34, the holders 24 and the two support sets 20, 20', the folding table of the present invention is convenient to assemble and disassemble for not involving use of any screwing parts tools. Furthermore, the present invention is good for mass production for it is effectively reducing the manufacturing cost.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention rather than limit the scope of the present invention. Accordingly, the foregoing description and drawings are by way of example only.

What is claimed is:

1. A folding table with a positioning function, comprising:

a table board;

two support sets pivotally connected with the table board and allowed to be folded to become parallel with the table board and unfolded to become perpendicular to and support the table board, and a fixing frame pivotally connected with the table board and between the two support sets, so that the fixing frame is allowed to be folded to become parallel with the table board and unfolded to become perpendicular to and support the table board in cooperation with the two support sets;

the folding table being characterized in that each said support set has at least one holder that has at least one positioning hole provided on one side thereof, and the fixing frame, at a free side thereof, has bilateral connecting ends, the connecting end having at least one through hole corresponding to the positioning hole and at least one spring member inserted in the connecting end, and the spring member projecting from the through hole with a pin corresponding to the positioning hole so as to make the pin removably engage the positioning hole, thereby when the pins engaging the positioning holes, the two support sets and the fixing frame being fixed and positioned with respect to each other.

2. The folding table claim 1, wherein the connecting end is hollow for accommodating the spring member therein.

3. The folding table of claim 1, wherein the spring member has a compressed portion, a propping portion extended upward from the compressed portion and the pin projected from the propping portion so as to make the spring member in an approximately U-like shape.

4. The folding table of claim 1, wherein the holder is in an approximately U-like shape and has a curved retaining surface formed inside for holding and retaining the connecting end.

5. The folding table of claim 1, wherein the holder has a guiding edge beyond the positioning hole for guiding the connecting end and pressing the pin back to the through hole.

* * * * *